US009708702B2

(12) United States Patent
Imai et al.

(10) Patent No.: US 9,708,702 B2
(45) Date of Patent: Jul. 18, 2017

(54) WIPING DEVICE AND HOT DIP COATING APPARATUS USING THE SAME

(71) Applicants: NIPPON STEEL & SUMITOMO METAL CORPORATION, Tokyo (JP); NIPPON STEEL & SUMIKIN COATED SHEET CORPORATION, Tokyo (JP)

(72) Inventors: Takeshi Imai, Tokyo (JP); Takeshi Tamura, Tokyo (JP); Seiji Sugiyama, Tokyo (JP); Kazuhiro Miyamoto, Tokyo (JP); Mitsuo Nishimata, Tokyo (JP); Yasushi Yamane, Hokkaido (JP)

(73) Assignees: NIPPON STEEL & SUMITOMO METAL CORPORATION, Tokyo (JP); NIPPON STEEL & SUMIKIN COATED SHEET CORPORATION, Tokyo (JP)

( * ) Notice: Subject to any disclaimer, the term of this patent is extended or adjusted under 35 U.S.C. 154(b) by 60 days.

(21) Appl. No.: 14/237,660

(22) PCT Filed: Sep. 21, 2012

(86) PCT No.: PCT/JP2012/074264
§ 371 (c)(1),
(2) Date: Feb. 7, 2014

(87) PCT Pub. No.: WO2013/042774
PCT Pub. Date: Mar. 28, 2013

(65) Prior Publication Data

US 2014/0202380 A1 Jul. 24, 2014

(30) Foreign Application Priority Data

Sep. 22, 2011 (JP) ..... 2011-208118

(51) Int. Cl.
*C23C 2/20* (2006.01)
*C23C 2/00* (2006.01)
(Continued)

(52) U.S. Cl.
CPC ..... *C23C 2/003* (2013.01); *C23C 2/14* (2013.01); *C23C 2/16* (2013.01); *C23C 2/18* (2013.01); *C23C 2/20* (2013.01)

(58) Field of Classification Search
CPC ..... C23C 2/20; C23C 2/14–2/18
See application file for complete search history.

(56) References Cited

U.S. PATENT DOCUMENTS 3,525,116 A * 8/1970 Shaffer ..... 15/309.1
2005/0247262 A1 11/2005 Yoshikawa et al.

FOREIGN PATENT DOCUMENTS

CN 1290768 A 4/2001
CN 100393907 C 6/2008
(Continued)

OTHER PUBLICATIONS

Chinese Office Action and Search Report for Chinese Application No. 201280007048.4,dated Nov. 26, 2014, including an English Translation of the Search Report.
(Continued)

*Primary Examiner* — Dah-Wei D Yuan
*Assistant Examiner* — Stephen Kitt
(74) *Attorney, Agent, or Firm* — Birch, Stewart, Kolasch & Birch, LLP

(57) ABSTRACT

A wiping device which blows a wiping gas toward a steel sheet from a pair of wiping nozzles disposed on both sides of the steel sheet so as to face sheet surfaces of the steel sheet, wherein the steel sheet is interposed between the pair of wiping nozzles and is pulled from a hot dip coating bath, the device includes a suctioning tube, wherein: the suction-
(Continued)

ing tube is disposed on both sides in a width direction of a section of the steel sheet, the section being positioned between the pair of wiping nozzles, so that the suctioning tube is in parallel to the steel sheet; the suctioning tube has a suctioning port that suctions an air; the suctioning port is disposed to face a side end surface of the steel sheet; a cross-sectional shape of the suctioning tube has the largest dimension thereof along a pulling direction of the steel sheet.

4 Claims, 12 Drawing Sheets

(51) Int. Cl.

| | |
|---|---|
| ***C23C 2/18*** | (2006.01) |
| ***C23C 2/14*** | (2006.01) |
| ***C23C 2/16*** | (2006.01) |

(56) References Cited

FOREIGN PATENT DOCUMENTS

| | | | |
|---|---|---|---|
| EP | 1063314 | A1 | 12/2000 |
| JP | 2-502169 | A | 7/1990 |
| JP | 9-143663 | A | 6/1997 |
| JP | 52-91740 | | 8/1997 |
| JP | 10-36953 | A | 2/1998 |
| JP | 2002-30408 | A | 1/2002 |
| JP | 2007-84878 | A | 4/2007 |
| WO | WO 89/04381 | A1 | 5/1989 |

OTHER PUBLICATIONS

International Search Report Issued in PCT/JP2012/074264, mailed on Dec. 25, 2012.
Extended European Search Report, dated Mar. 31, 2015, for European Application No. 12832927.3.
Korean Notice of Allowance and English translation thereof, dated Mar. 31, 2015, for Korean Application No. 10-2013-7018938.

* cited by examiner

WIPING DEVICE AND HOT DIP COATING APPARATUS USING THE SAME

FIELD OF THE INVENTION

The present invention relates to a wiping device and a hot dip coating apparatus using the same.

Priority is claimed on Japanese Patent Application No. 2011-208118, filed on Sep. 22, 2011, the content of which is incorporated herein by reference.

RELATED ART

FIG. 14 is a cross-sectional view illustrating the summary of a continuous hot dip coating apparatus. As illustrated in FIG. 14, in the continuous hot dip coating apparatus 11, a steel sheet P is dipped in a hot dip coating bath 12 from a snout 13 to coat the steel sheet P with molten metal and is pulled via a sink roll 14 to be subjected to gas wiping by wiping nozzles 15 such that coating is performed thereon.

During gas wiping by the wiping nozzles 15, wiping gas is blown from the wiping nozzles 15 disposed on both sides of the steel sheet P interposed therebetween. This process causes the molten metal adhered to the surface of the steel sheet P to have a uniform coating thickness in the width direction and the longitudinal direction. As a result, excessive molten metal is wiped out, and the amount of molten metal adhered is controlled. The wiping nozzles 15 is constituted so as to blow the wiping gas from slits that extend in the width direction of the steel sheet P, and the slit is longer than the width of the steel sheet P to correspond to the widths of various steel sheets P, that is, extends to the outside from an edge portion of the steel sheet P.

The wiping gas blown from the wiping nozzles 15 collides with the steel sheet P as a high-speed jet and is thereafter separated in the vertical direction such that the excessive molten metal is wiped out in the vertical direction to realize a uniform coating thickness. However, at the edge portion of the steel sheet P, since the jet that collides with the edge portion comes off in the horizontal direction, the collision force of the jet is reduced, and thus the coating thickness of the edge portion becomes greater than that of the center portion, that is, so-called edge overcoating occurs. In addition, so-called splash in which the molten metal scatters around due to the disturbance of the jet that collides with the edge portion occurs, and thus the molten metal adheres to the surface of the steel sheet, resulting in degradation of the surface quality of the steel sheet P.

In an attempt to solve such problems, for example, Patent Document 1 describes the following suggestion. In the description, a main nozzle that blows gas to mainly control the thickness of adhered metal and an auxiliary nozzle that is tilted with respect to the blow direction of the gas blown from the main nozzle and blows gas having a lower speed than that of the gas blown from the main nozzle are provided. Thus, the gas jet blown from the main nozzle is prevented from diffusing, by the virtue of the low-speed jet from the auxiliary nozzle.

In addition, Patent Document 2 describes the following suggestion. In the description, edge plates (with a thickness of 0.5 mm and a width of 755 mm) are arranged on both sides in the width direction of a steel sheet, and in parallel to the steel sheet. The edge plates are separated from the side end surfaces of the steel sheet at an appropriate interval. Further, a band plate is mounted to a part of the edge plate that opposes the side end surface of the steel sheet. This arrangement prevents gas on the edge plate side and gas on the steel sheet from colliding with each other, and prevents generation of turbulence of the gas, thereby preventing edge overcoating. In addition, in Patent Document 3, an apparatus which is provided with a suctioning nozzle that opposes a side end surface of a steel sheet and which removes extra molten metal using an air pressure is suggested.

REFERENCE DOCUMENT

Patent Document

[Patent Document 1]: Japanese Unexamined Patent Application, First Publication No. 2007-84878

[Patent Document 2]: Japanese Unexamined Patent Application, First Publication No. H10-36953

[Patent Document 3]: Japanese Unexamined Patent Application, First Publication No. H09-143663

DISCLOSURE OF THE INVENTION

Problems to be Solved by the Invention

As described in Patent Document 1, in the case where the auxiliary nozzle is fixed onto the main nozzle, when the distance between the main nozzles on both sides of the steel sheet is changed, for example, increased, the auxiliary nozzle impedes the jet from the main nozzle, and thus the wiping effect is reduced. In addition, as described in Patent Document 2, when the edge plates and the band plates are installed, the collision pressure of the wiping gas against the edge portion of the steel sheet is increased. Thus, there is an increase in splash of the molten metal, and the splash adheres between the steel sheet and the band plate, resulting in quality detects in the edge.

In addition, in the apparatus of Patent Document 3, the shape of a suctioning tube is circular, and thus the flow in the vicinity of the suctioning tube is disturbed and splash is likely to occur. In addition, since the molten metal is suctioned by the suctioning nozzle, there is a problem in that the suctioned molten metal adheres to the nozzle and thus the nozzle becomes clogged.

An object of the present invention is to provide a wiping device capable of preventing edge overcoating and splash by improving the flow of wiping gas at an edge portion of a steel sheet, and a hot dip coating apparatus using the same.

Methods for Solving the Problem

In order to accomplish the object related to solving the above-described problems, the inventors had employed the following:

(1) An aspect of the present invention relates to a wiping device which blows a wiping gas toward a steel sheet from a pair of wiping nozzles disposed on both sides of the steel sheet so as to face sheet surfaces of the steel sheet, wherein the steel sheet is interposed between the pair of wiping nozzles and is pulled from a hot dip coating bath, the device includes a suctioning tube, wherein: the suctioning tube is disposed on both sides in a width direction of a section of the steel sheet, the section being positioned between the pair of wiping nozzles, so that the suctioning tube is in parallel to the steel sheet; the suctioning tube has a suctioning port that suctions an air; the suctioning port is disposed to face a side end surface of the steel sheet; a cross-sectional shape of the suctioning tube has the largest dimension thereof along a pulling direction of the steel sheet.

(2) In the wiping device described in (1), a width of the suctioning tube in the pulling direction of the steel sheet may be 15 to 50 mm.

(3) In the wiping device described in (1) or (2), in the suctioning tube, a ratio of a long side with respect to a short side of the cross section may be 1.2 to 10.

(4) In the wiping device described in (1) or (2), a distance between the suctioning port and the side end surface of the steel sheet may be 2 to 15 mm.

(5) In the wiping device described in (3), a distance between the suctioning port and the side end surface of the steel sheet may be 2 to 15 mm.

(6) A hot dip coating apparatus according to another aspect of the present invention, includes the wiping device described in (1) or (2).

(7) A hot dip coating apparatus according to another aspect of the present invention, includes the wiping device described in (3).

(8) A hot dip coating apparatus according to another aspect of the present invention, includes the wiping device described in (4).

(9) A hot dip coating apparatus according to another aspect of the present invention, includes the wiping device described in (5).

According to the wiping device of the present invention, the wiping gas blown from the wiping nozzles is vertically separated after colliding with the steel sheet as a high-speed jet to wipe out excessive molten metal in the vertical direction, and thus the pressure distribution in the width direction is uniformized, thereby realizing a uniform coating thickness. Here, the wiping gas blown from the pair of wiping nozzles to the outside in the width direction of the steel sheet collides with the suctioning tube disposed on both sides in the width direction of the steel sheet between the pair of wiping nozzles and is vertically separated. Here, since the shape of the cross section of the suctioning tube has the largest dimension thereof along the pulling direction of the steel sheet, the wiping gas that collides with the suctioning tube and is vertically separated is guided vertically along the convex shape of the outside of the suctioning tube to be rectified. Therefore, the generation of turbulence caused by a direct collision between the flows of the wiping gas on the outside of the steel sheet is prevented. At the same time, by suctioning the air from the suctioning port disposed to face the side end surface of the steel sheet, variations in the position of the collision point of the wiping gas between the edge portion of the steel sheet and the tip end portion of the suctioning tube are suppressed, and thus a reduction in the gas pressure caused by variations in the collision point is suppressed. Therefore, a reduction in the collision force of the jet of the wiping gas at the edge portion of the steel sheet can be suppressed. Moreover, the generation of splash caused by the generation of turbulence is prevented, thereby avoiding quality troubles.

Effects of the Invention

According to the aspects described in (1) to (9), the suctioning port which is disposed on both sides in the width direction of the steel sheet between the pair of wiping nozzles in parallel to the steel sheet and suctions air is disposed to face the side end surface of the steel sheet. In addition, by providing the suctioning tube in which the shape of the cross section has the largest dimension thereof along the pulling direction of the steel sheet, the generation of turbulence caused by a direct collision between the flows of the wiping gas on the outside of the steel sheet can be prevented, and a reduction in the collision force of the jet of the wiping gas exerted on the steel sheet at the edge portion of the steel sheet can be suppressed. Therefore, it is possible to prevent edge overcoating and splash.

EMBODIMENTS OF THE INVENTION

Figure 1:
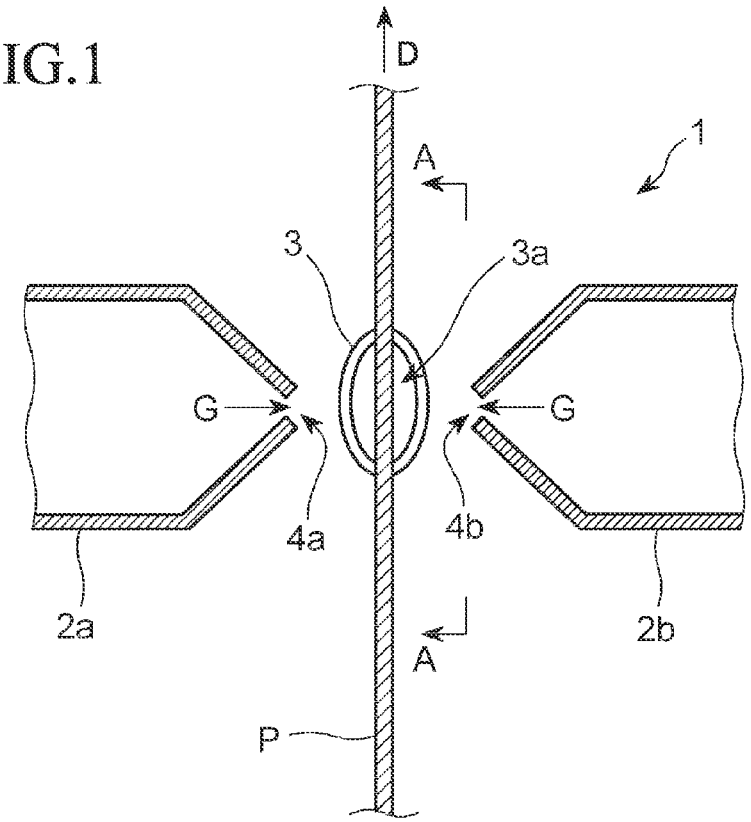
FIG. 1 is a longitudinal sectional view of a wiping device according to an embodiment of the present invention.
Figure 2:
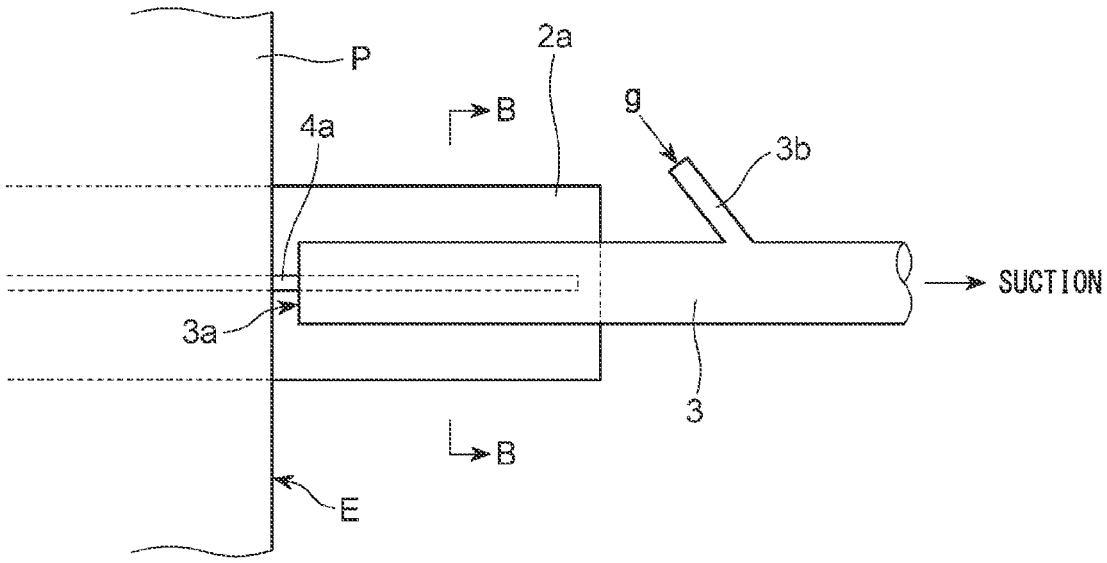
FIG. 2 is a diagram of an edge portion of a steel sheet of FIG. 1, taken along the arrow A-A.

FIG. 1 is a longitudinal sectional view of a wiping device 1 according to an embodiment of the present invention. FIG. 2 is a diagram of an edge portion of a steel sheet P of FIG. 1, taken along the arrow A-A.

Figure 14:
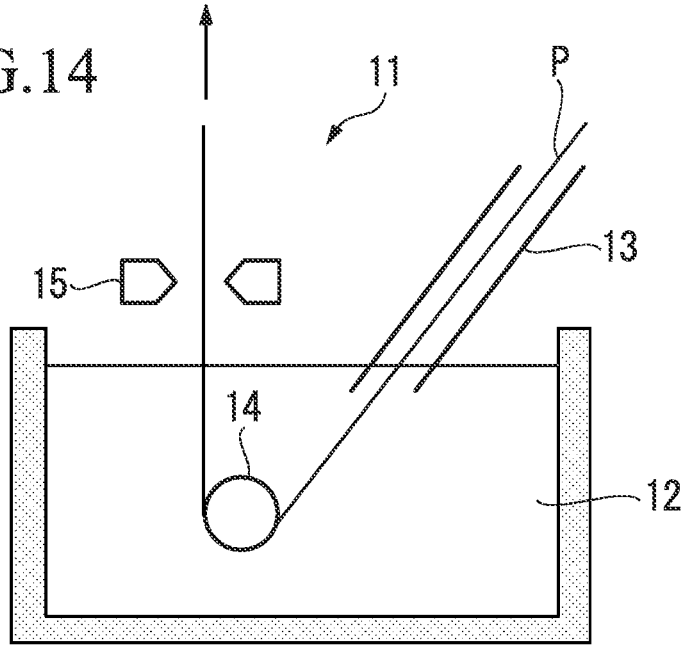
FIG. 14 is a cross-sectional view illustrating the summary of a continuous hot dip coating apparatus.

As illustrated in FIGS. 1 and 2, the wiping device 1 in the embodiment of the present invention is included in the above-described continuous hot dip coating apparatus 11 as illustrated in FIG. 14. In addition, a pair of wiping nozzles 2*a* and 2*b* disposed on both sides of a steel sheet P interposed therebetween, which is pulled from the hot dip coating bath 12, and suctioning tubes 3 disposed on both sides in the width direction of the steel sheet P between the pair of wiping nozzles 2*a* and 2*b* in parallel to the steel sheet P are included.

The wiping nozzles 2*a* and 2*b* are nozzles which respectively blow wiping gas G toward the sheet surfaces of the steel sheet P from linear slits 4*a* and 4*b* that extend in the width direction of the steel sheet. The slits 4*a* and 4*b* are formed to be longer than the width of the steel sheet P as illustrated in FIG. 2 to correspond to the widths of various steel sheets P and extend to the outside from edge portions E of the steel sheet P. The wiping gas G blown onto the sheet surfaces of the steel sheet P from the wiping nozzles 2*a* and 2*b* is separated in the vertical direction after colliding with the steel sheet P as a high-speed jet and wipes out excessive molten metal.

The suctioning tube 3 is a tube which has a suctioning port 3*a* that suctions air and is disposed to face a side end surface of the steel sheet P, and has an oval cross section. The suctioning tube 3 is disposed so that the long side of the oval cross section is in a pulling direction D of the steel sheet P. In addition, at the intermediate position of the suctioning tube 3, a supply tube 3*b* that supplies driving gas g for operating the suctioning tube 3 as an ejector is provided. By supplying the driving gas g at a high pressure to the supply tube 3*b*, air in the vicinity of the edge portion E of the steel sheet P is suctioned from the suctioning tube 3*a*.

Figure 3A:
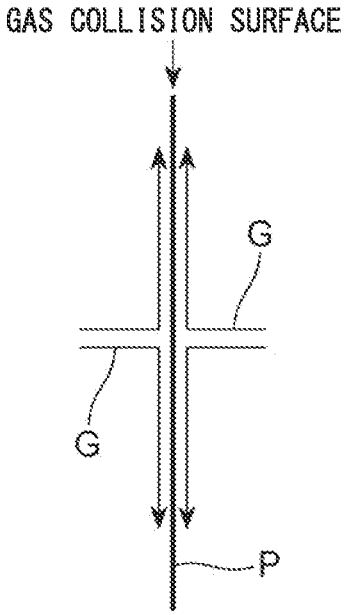
FIG. 3A is a cross-sectional view of a center portion in the width direction of the steel sheet.
Figure 3B:
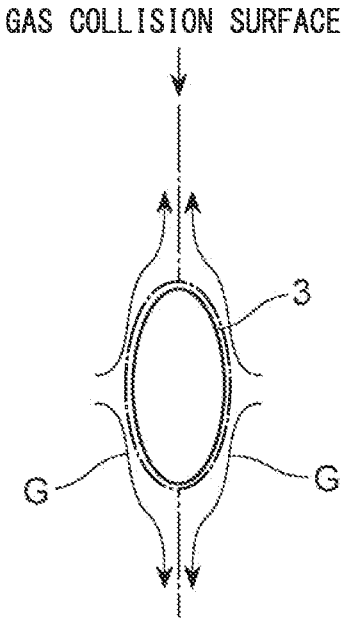
FIG. 3B is a diagram taken along the arrow B-B of FIG. 2.
Figure 3C:
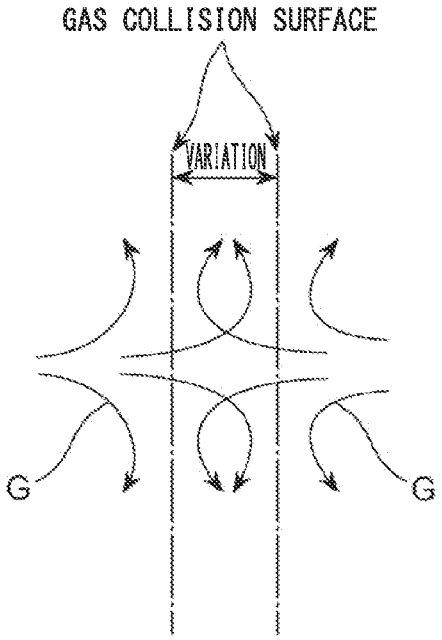
FIG. 3C is a diagram taken along the arrow B-B of FIG. 2 in a case where there is no suctioning tube.

FIGS. 3A, 3B, and 3C are diagrams visualizing the flow of the wiping gas G blown from the wiping nozzles 2*a* and 2*b*. FIG. 3A is a cross-sectional view of a center portion C in the width direction of the steel sheet P. FIG. 3B is a diagram taken along the arrow B-B of FIG. 2. As illustrated in FIG. 3A, at the center portion C in the width direction of the steel sheet P, the wiping gas G that collides with the steel sheet P is vertically and uniformly distributed. On the other hand, as illustrated in FIG. 3B, the wiping gas G that collides with the suctioning tube 3 is vertically separated and is thereafter guided vertically along the convex shape of the outside of the suctioning tube 3 having the oval cross section to be rectified. Therefore, similarly to the center portion C in the width direction, the center of the suctioning tube 3 becomes the collision point of the wiping gas G as if the steel sheet P is present, thereby forming a stable flow. In addition, in a case where the suctioning tube 3 is not present, flows of the wiping gas G respectively blown from the pair of wiping nozzles 2*a* and 2*b* directly collide with each other. In this case, the flow of gas is not specified by a solid matter (the steel sheet P or the suctioning tube 3) like the cases of FIGS. 3A and 3B, and thus all the slight fluctuations of the gas flow at each spatial point are reflected, and the collision points of the flows of the wiping gas are determined. Therefore, as illustrated in FIG. 3C, the collision points of the wiping gas G are not fixed to a single point but the positions thereof are changed, resulting in a complex turbulence in the vicinity.

According to the wiping device 1 having the above configuration, the wiping gas G blown from the wiping nozzles 2*a* and 2*b* is vertically separated after colliding with the steel sheet P as a high-speed jet to wipe out the excessive molten metal in the vertical direction, and thus the pressure distribution in the width direction is uniformized, thereby realizing a uniform coating thickness. Here, the wiping gas G blown from the wiping nozzles 2*a* and 2*b* to the outside in the width direction of the steel sheet P is guided vertically along the convex shape of the outside of the suctioning tube 3 as described above to be rectified. Therefore, the generation of turbulence caused by a direct collision between the flows of the wiping gas G on the outside of the steel sheet P is prevented.

In addition, in the wiping device 1, in addition to the above-described effect, by suctioning the air from the suctioning port 3*a* of the suctioning tube 3 disposed to face the side end surface of the steel sheet P, variations in the collision point of the wiping gas G formed between the edge portion E of the steel sheet P and the suctioning tube 3 are suppressed, and thus a reduction in the gas pressure is suppressed. Therefore, the amount of wiping gas G coming off in the horizontal direction from the edge portion E of the steel sheet P is reduced. Accordingly, a reduction in the collision force of the jet of the wiping gas G at the edge portion E of the steel sheet P is also suppressed.

Figure 4A:
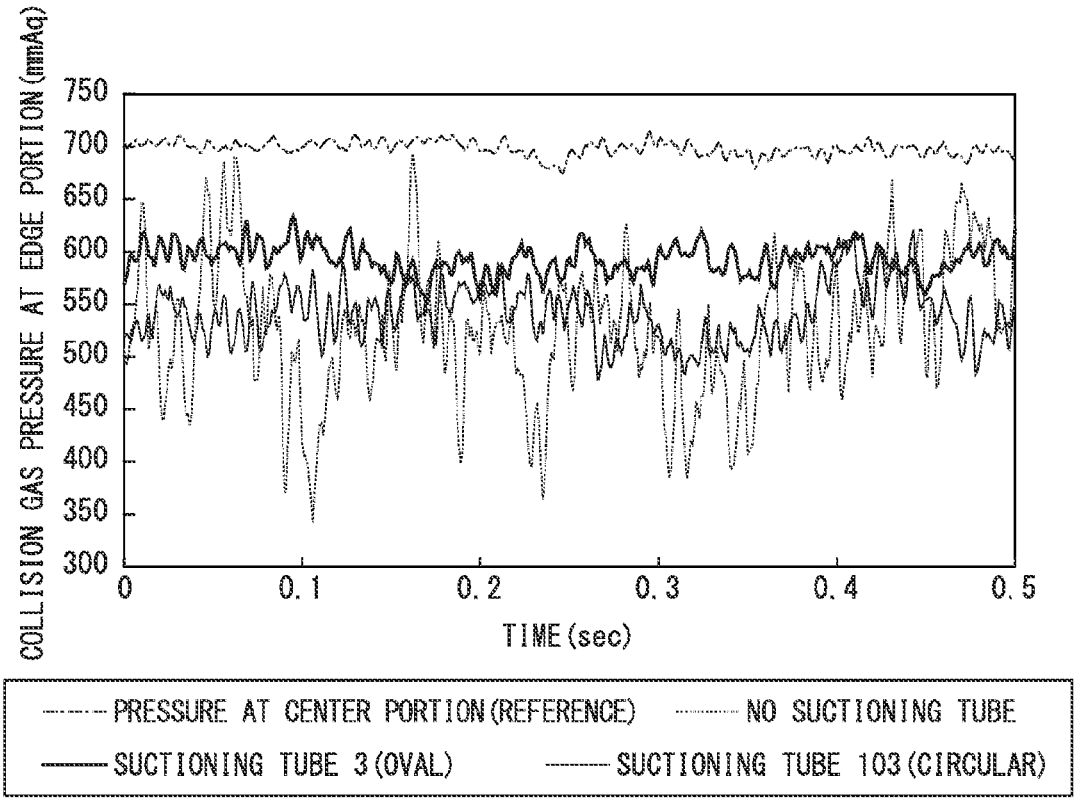
FIG. 4A is a diagram showing a graph of variations in a collision gas pressure of wiping gas at the edge portion of the steel sheet.
Figure 4B:
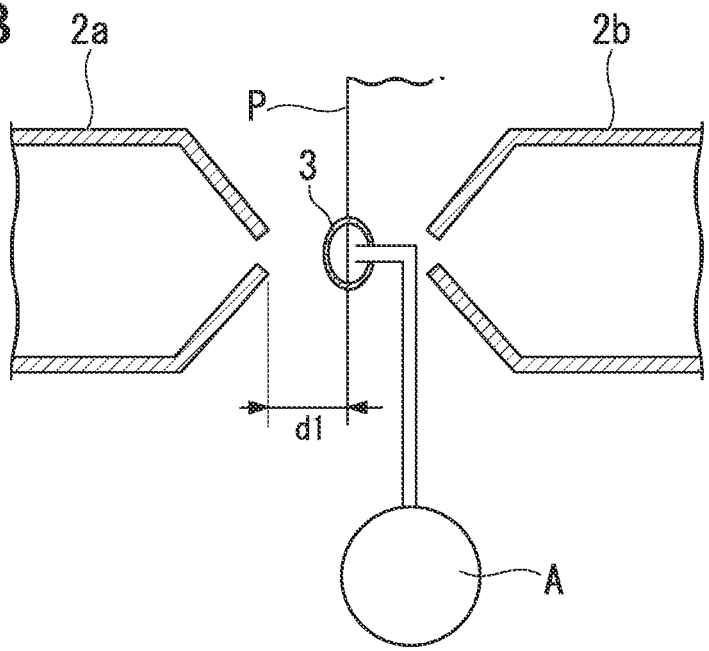
FIG. 4B is a schematic diagram of an apparatus for measuring variations in the collision gas pressure of the wiping gas at the edge portion of the steel sheet.
Figure 4C:
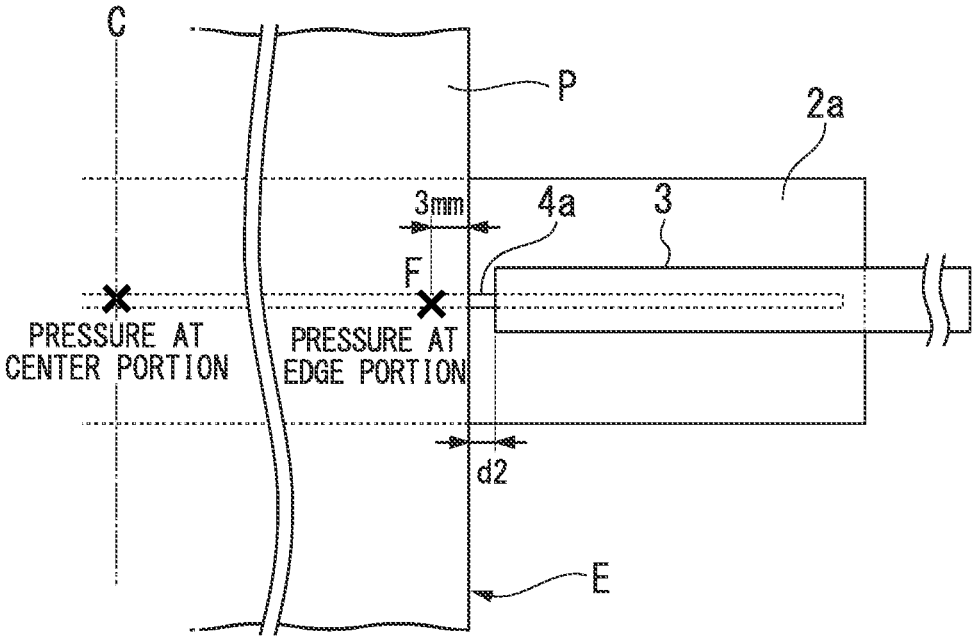
FIG. 4C is an arrangement diagram of the apparatus for measuring variations in the collision gas pressure of the wiping gas at the edge portion of the steel sheet.

Next, a confirmation test was conducted on an effect of preventing edge overcoating and splash S by the suctioning tube 3 of the wiping device 1 in this embodiment. As for wiping conditions, a distance d1 between each of the wiping nozzles 2*a* and 2*b* and the steel sheet P was 8 mm, and the amount of gas from each of the wiping nozzles 2*a* and 2*b* was 700 $Nm^3$/Hr. As for suctioning tube conditions, a distance d2 between the edge portion E of the steel sheet P and the suctioning tube 3 was 5 mm, and the oval suctioning tube 3 having a 25 mm long side and a 15 mm short side and a circular suctioning tube 103 having a diameter of 15 mm were used. The collision gas pressure was measured by a pressure gauge A (a digital pressure gauge made by OKANO WORKS, LTD. was used). Measurement in FIG. 4A was performed at a point F disposed inward from the edge portion E of the steel sheet P by 3 mm in the center portion C of the steel sheet P (see FIG. 4C). As illustrated in FIG. 4A, in the wiping device 1 of this embodiment, the average collision gas pressure at the point F disposed inward from the edge portion E of the steel sheet P by 3 mm in the center portion C of the steel sheet P is close to the pressure of the center portion C and is thus greater than that of the case where there is no suctioning tube 3 and the case where the suctioning tube 103 having the circular cross section is used. In addition, pressure variations are reduced, and thus it is thought that the rectification effect by the suctioning tube 3 is exerted.

Figure 5A:
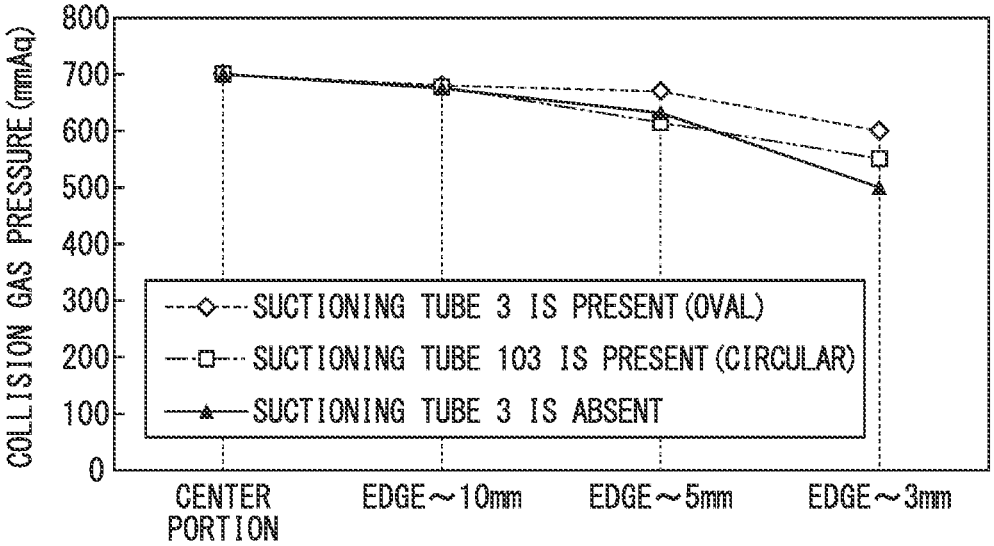
FIG. 5A is a diagram showing a graph of a distribution of the collision gas pressure of the wiping gas in the width direction of the steel sheet.
Figure 5B:
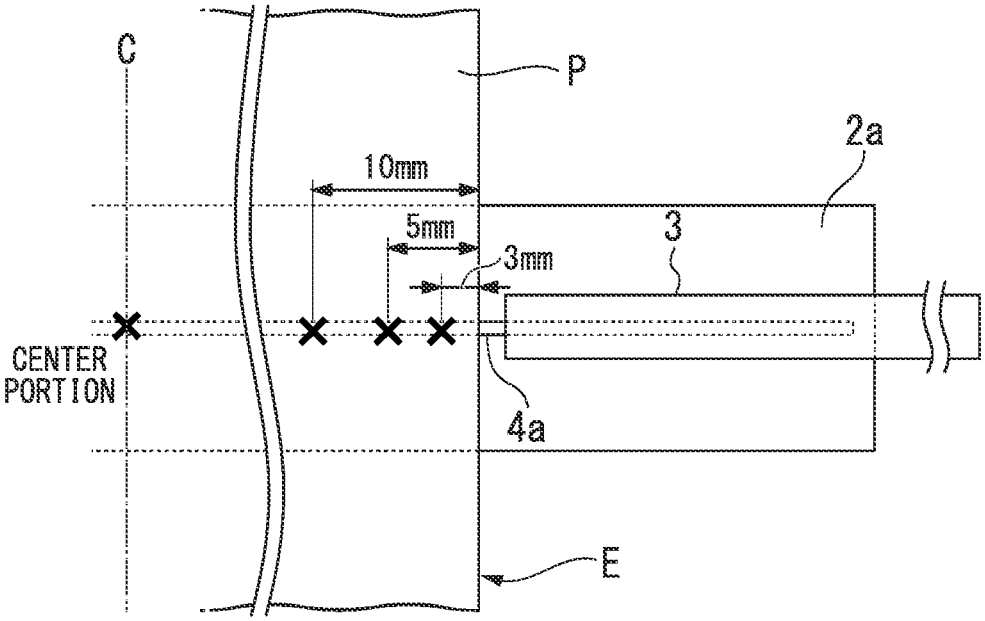
FIG. 5B is an arrangement diagram of an apparatus for measuring the distribution of the collision gas pressure of the wiping gas in the width direction of the steel sheet.

As illustrated in FIG. 5A, in the wiping device 1 in this embodiment, since the oval suctioning tube 3 is provided, compared to the case where there is no suctioning tube and the case where the circular suctioning tube 103 is used, a pressure drop at the point F disposed inward from the edge portion E of the steel sheet P by 3 mm in the center portion C of the steel sheet P is suppressed.

As described above, in the wiping device 1 in this embodiment, the collision gas average pressure at the point F disposed inward from the edge portion E of the steel sheet P by 3 mm in the center portion C of the steel sheet P is a pressure close to the pressure of the center portion C due to the suctioning tube 3. Therefore, pressure variations are small and the pressure drop at the point F disposed inward from the edge portion E of the steel sheet P by 3 mm in the center portion C of the steel sheet P is suppressed. Accordingly, the same wiping effect as that of the center portion C is obtained at the point F disposed inward from the edge portion F of the steel sheet P by 3 mm in the center portion C of the steel sheet P, and thus it is possible to prevent edge overcoating.

Figure 6:
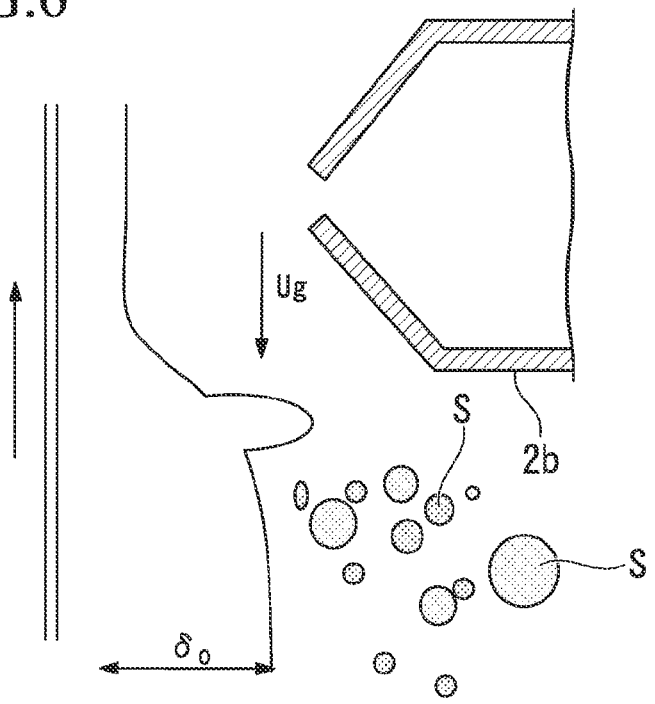
FIG. 6 is a conceptual diagram of the generation of splash.

Next, the effect of preventing splash S by the wiping device 1 in this embodiment will be described in detail (FIG. 6). Generation conditions of splash S of the molten metal wiped out by the wiping gas G are quantified by similitude experiments that use various liquids. As an idea, splash S of molten metal is associated with inertial force ($\rho\delta_0^2 \cdot Ug^2$) by the wiping gas G and surface tension ($\sigma/\delta_0$) that is exerted on the molten metal (here, p: density, $\delta_0$: liquid film lifted by stripping, Ug: speed of wiping gas, $\sigma$: surface tension of molten metal).

In the wiping device 1 in this embodiment, as illustrated in FIGS. 4A and 5A, the collision gas average pressure at the edge portion E is increased. However, as described above, due to the shape of the suctioning tube 3 and suctioning of air from the suctioning port 3*a*, the flow of the wiping gas G at the edge portion E is rectified and is improved to be in the vertical direction of the steel sheet P from the outside of the steel sheet P, thereby preventing the splash S from scattering to the outside of the steel sheet P.

Figure 7A:
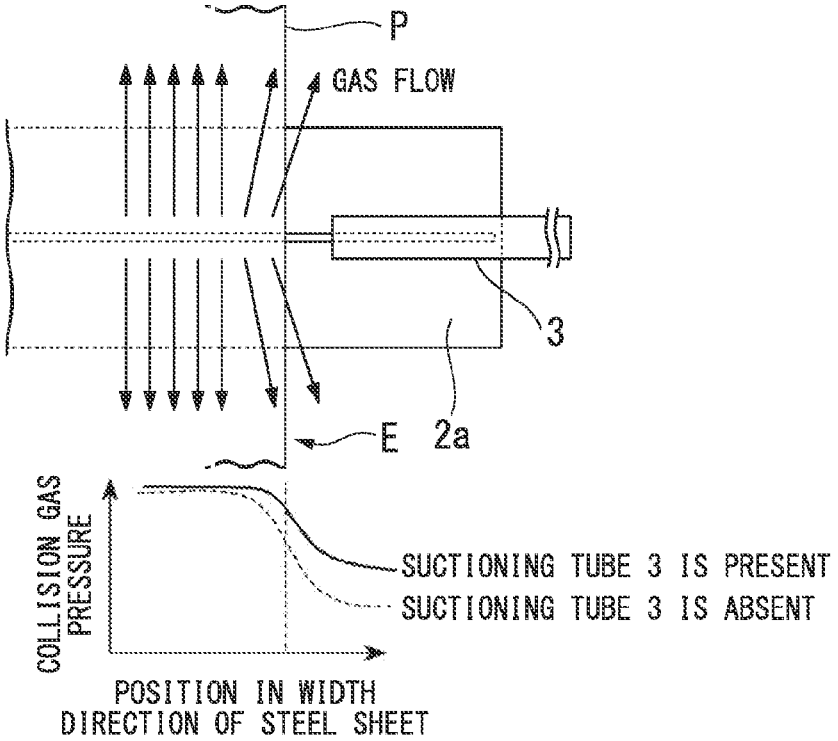
FIG. 7A is a conceptual diagram of a gas flow at the edge portion of the steel sheet (presence or absence of the suctioning tube).
Figure 7B:
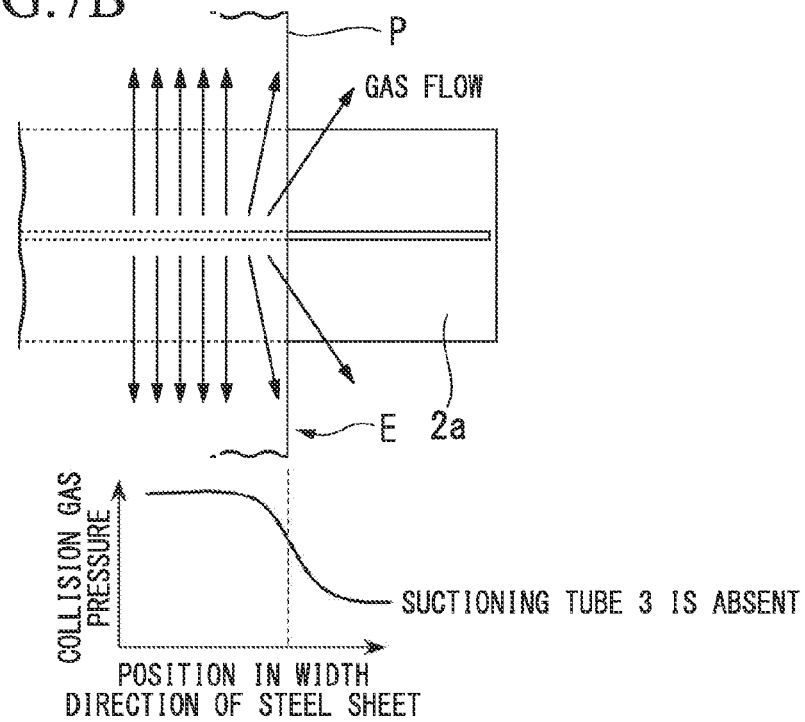
FIG. 7B is a conceptual diagram of a gas flow at the edge portion of the steel sheet (in a case of a high pressure drop).

Although the wiping gas G is distributed in the vertical direction when colliding with the steel sheet P, in the wiping device 1 according to the related art, since the collision point is changed on the outside of the edge portion E of the steel sheet P, kinetic energy of the gas is reduced, and thus the collision gas average pressure is reduced. As a result of the reduction in the collision gas pressure at the point F disposed inward from the edge portion E of the steel sheet P by 3 mm in the center portion C of the steel sheet P as described above, a gas pressure difference occurs at the edge portion E of the steel sheet P, and thus the gas that collides with the edge portion E of the steel sheet P flows outward due to the pressure difference. As illustrated in FIG. 7B, as the disturbance of the gas flow on the outside of the edge portion E of the steel sheet P is increased, a pressure gradient is increased, and thus the gas flow toward the outside of the steel sheet is increased. In this case, splash S generated by the wiping gas G scatters to the edge portion E of the steel sheet P.

Figure 7C:
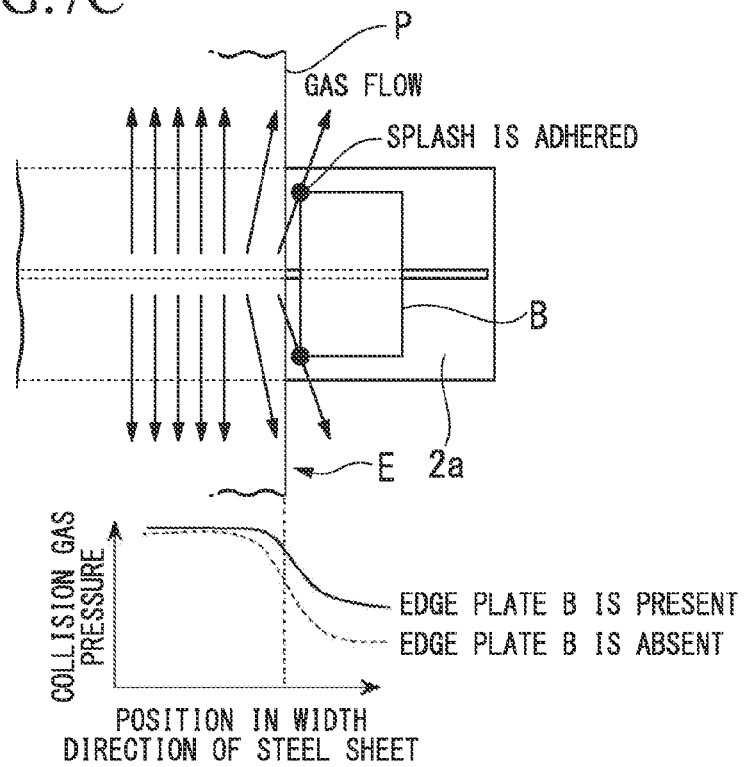
FIG. 7C is a conceptual diagram of a gas flow at the edge portion of the steel sheet (presence or absence of an edge plate).

In addition, as illustrated in FIG. 7C, in a case where a rectifying plate such as an edge plate B is installed on the outside of the edge portion E of the steel sheet P, a pressure drop at the edge portion E is suppressed by the rectification effect, and as a result, scattering of the splash S in the horizontal direction is suppressed. However, the edge plate B needs to be installed to be close to the edge portion E of the steel sheet P, and thus splash S is adhered and deposited thereto. This results in the generation of scratch of the edge portion E of the steel sheet P. On the other hand, as illustrated in FIG. 7A, in the wiping device 1 in this embodiment, by supplying the driving gas g to the supply tube 3*b* of the suctioning tube 3 and suctioning air from the suctioning port 3*a*, collision of the flows of the wiping gas G on the outside of the edge portion E is stabilized even when the distance between the suctioning tube 3 and the edge portion E of the steel sheet P is increased, thereby suppressing the pressure drop at the edge portion E.

Next, as an index indicating the rectification effect by the suctioning tube 3, the edge plate B, or the like, a collision gas pressure ratio (Pe/Pc) of the edge portion E to the center portion C of the steel sheet P was defined, and the relationship between the collision gas pressure ratio (Pe/Pc) and a splash scattering angle θ was experimentally examined (Pe: the collision gas pressure of the edge portion E of the steel sheet P, Pc: the collision gas pressure of the center portion C of the steel sheet P). The collision gas pressure ratio (Pe/Pc) was adjusted by changing the shape of the cross section of the suctioning tube 3 and the amount of air supplied to the suctioning tube. From FIG. 8B, it can be seen that scattering of the splash S in the horizontal direction is increased as the gas pressure at the edge portion E is reduced. Therefore, it is thought that when the distance between the edge portion E of the steel sheet P and the rectification device is reduced, the amount of splash S adhered is increased. Here, as an index of rectification, the collision gas pressure ratio (Pe/Pc) of the edge portion E to the center portion C of the steel sheet P was used.

Figure 9:
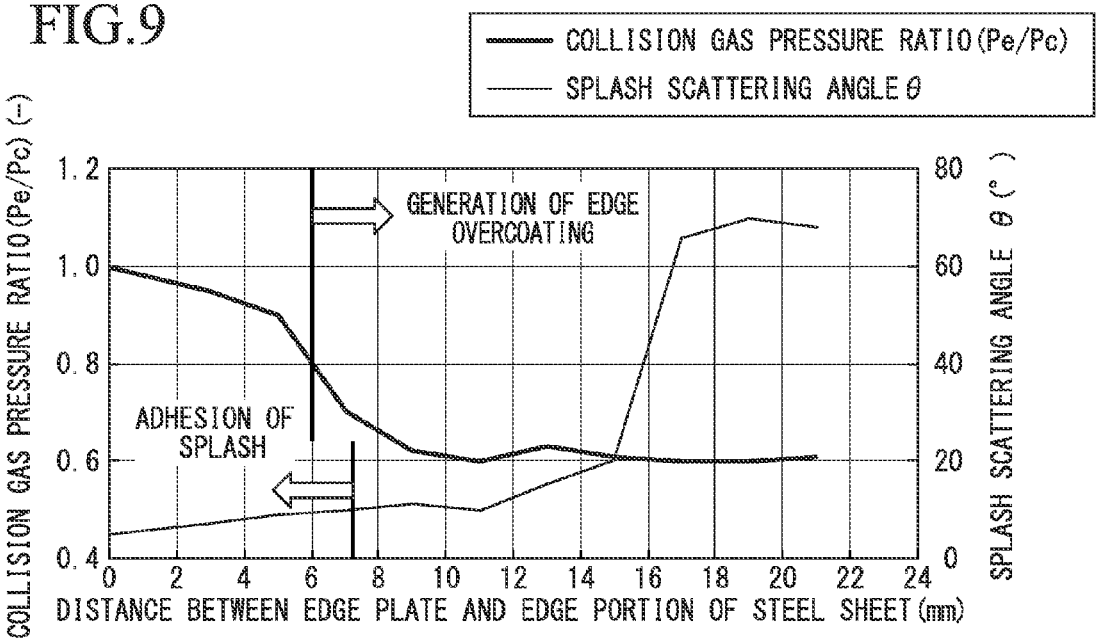
FIG. 9 is a diagram showing the relationships between the distance between an edge plate and the edge portion of the steel sheet, and the collision gas pressure ratio (Pe/Pc) and the splash scattering angle θ in a case where the edge plate is used.
Figure 10:
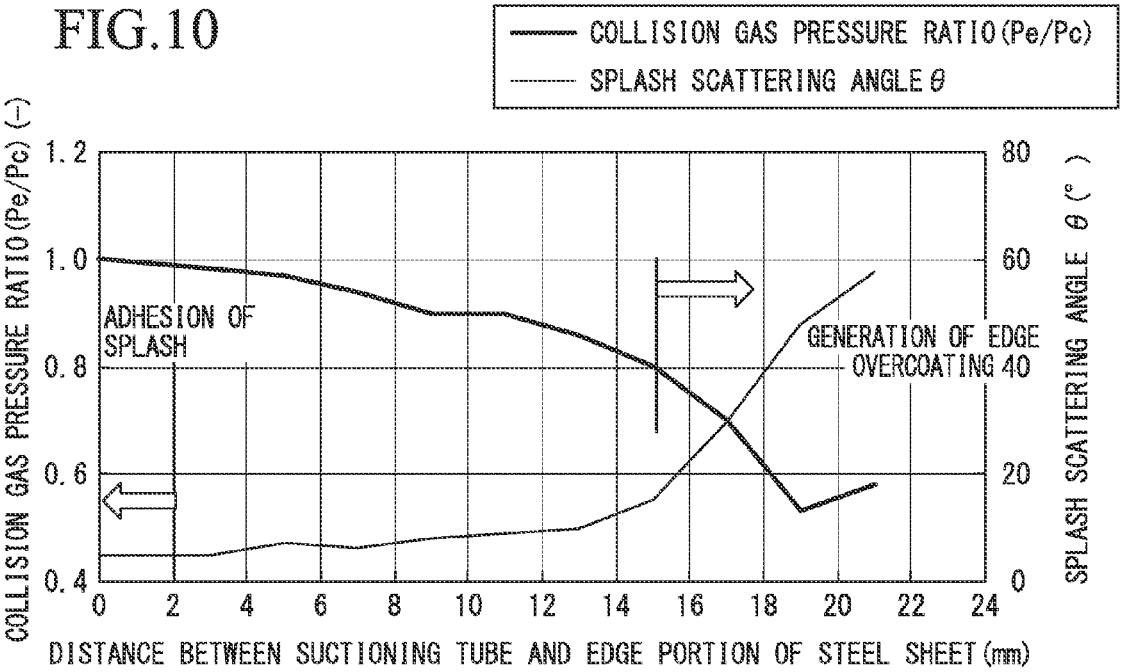
FIG. 10 is a diagram showing the relationships between the distance between the suctioning tube and the edge portion of the steel sheet, and the collision gas pressure ratio (Pe/Pc) and the splash scattering angle θ in a case where the suctioning tube is used.

In FIGS. 9 and 10, the relationships between the installation positions of the edge plate B and the suctioning tube 3, and each of the collision gas pressure ratio (Pe/Pc) and the splash scattering angle θ was arranged. As shown in FIG. 9, in the case of the edge plate B, when the collision gas pressure ratio (Pe/Pc) was less than 0.8, edge overcoating occurred. Therefore, as a countermeasure to edge overcoating, 0.8 or higher of collision gas pressure ratio (Pe/Pc) is needed. In addition, the distance between the edge plate B and the edge portion E of the steel sheet P needs to be ensured to be 6 mm or less. However, in this case, although the splash scattering angle θ is about 10°, the edge plate B is close to the edge portion E of the steel sheet P. In addition, it was determined that when the distance between the edge plate B and the edge portion E of the steel sheet P is 7 mm or less, splash S is adhered and thus an operation for a long term is difficult.

On the other hand, in a case where the suctioning tube 3 in this embodiment is used, as shown in FIG. 10, by setting the distance between the suctioning tube 3 and the edge portion E of the steel sheet P to be 15 mm or less, it is possible to stably avoid edge overcoating. In addition, by setting the distance between the suctioning tube 3 and the edge portion E of the steel sheet P to be 2 mm or greater, adhesion of splash S can be more reliably avoided. From the above description, it was determined that by installing the distance between the suctioning tube 3 and the edge portion E of the steel sheet P to be in a range of 2 to 15 mm, it is possible to use the components in an operation for a long term.

Figure 8A:
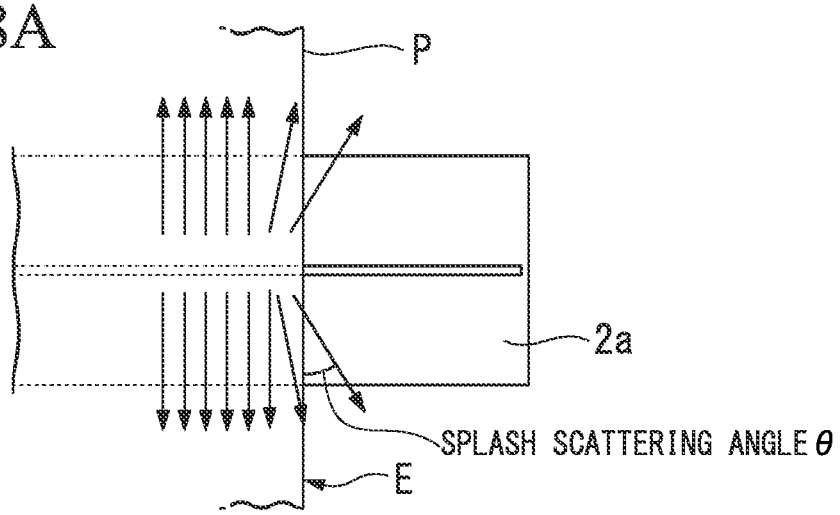
FIG. 8A is a schematic diagram of a splash scattering angle θ at the edge portion of the steel sheet.
Figure 8B:
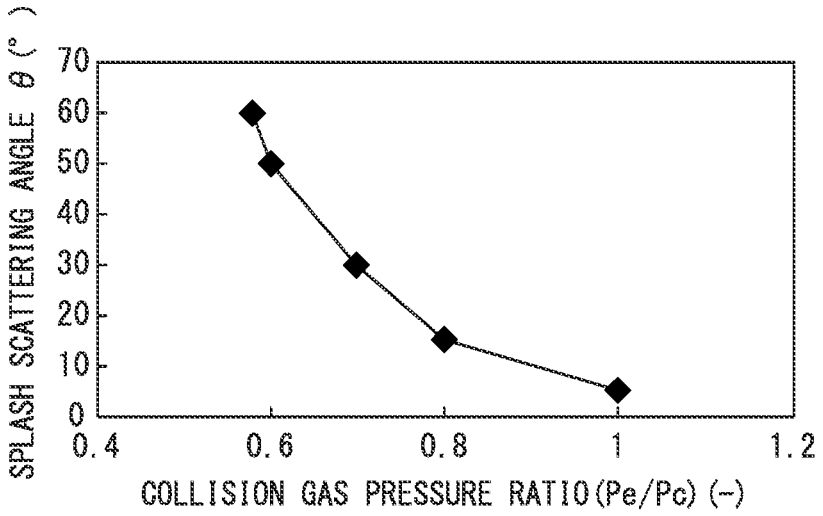
FIG. 8B is a diagram of the relationship between a collision gas pressure ratio (Pe/Pc) and the splash scattering angle θ.
Figure 11:
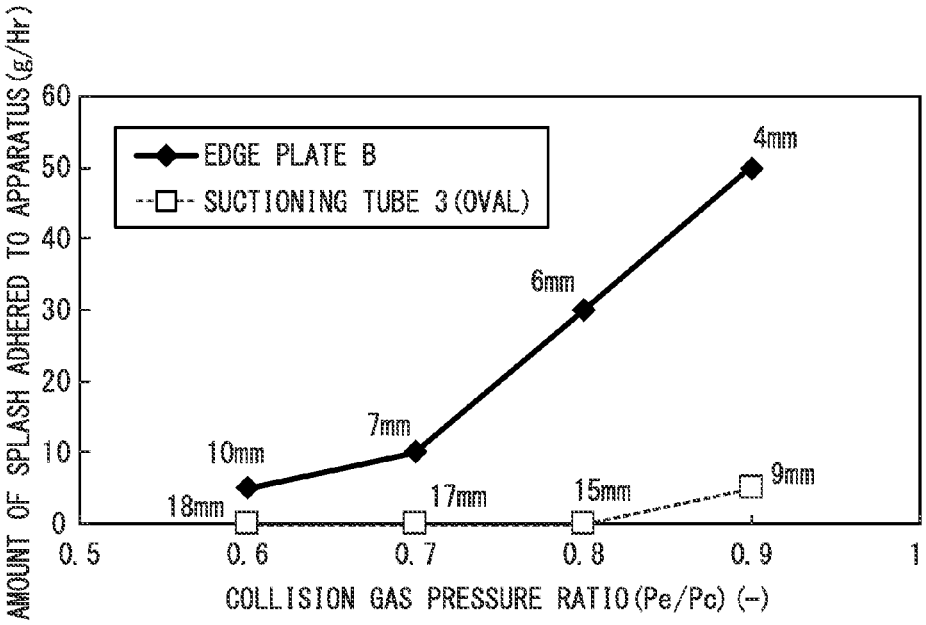
FIG. 11 is a diagram showing the relationship between the collision gas pressure ratio (Pe/Pc) of the edge portion with respect to the center portion of the steel sheet and the amount (g/Hr) of splash adhered to the apparatus at the distance between each of the rectification devices and the edge portion of the steel sheet regarding the suctioning tube in this embodiment and the edge plate according to the related art.

Numbers in FIG. 11 represent the distance between each rectification device and the edge portion E of the steel sheet P. As shown in FIGS. 9 and 10, in any rectification device, a pressure drop at the edge portion E can be suppressed by setting the distance between the corresponding rectification device to the edge portion E of the steel sheet P under a predetermined condition. However, in a case of the same distance, when the suctioning tube 3 is used, the collision gas pressure ratio (Pe/Pc) is significantly improved. This is because, by using the suctioning tube 3, in addition to the effect of suppressing the generation of turbulence caused by a direct collision between the flows of the wiping gas G on the outside of the steel sheet P, variations in the collision point between the flows of the wiping gas G due to suctioning of air from the suctioning tube 3 are suppressed. In order to obtain a predetermined (0.8 or higher) collision gas pressure ratio (Pe/Pc), in the case of the edge plate B, as shown in FIG. 11, it was determined that the amount of splash adhered to the edge plate B is increased. As shown in FIG. 8B, when the pressure ratio is improved, scattering of the splash S in the horizontal direction is improved. However, in the case of the edge plate B, the edge plate B needs to be close to the edge portion E of the steel sheet P, and thus it is difficult to avoid adhesion of the splash S. On the other hand, in the wiping device 1 in this embodiment, it is possible to increase the distance between the suctioning tube 3 and the edge portion E of the steel sheet P, and it is possible to avoid adhesion of splash S regardless of the pressure ratio. Therefore, in the continuous hot dip coating apparatus, it is possible to uniformize the coating thickness in the width direction for a long term.

Figure 12A:
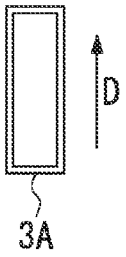
FIG. 12A is a diagram illustrating the shape of the cross section of a suctioning tube according to a modification example.
Figure 12B:
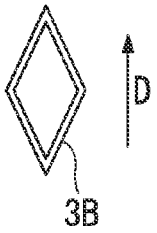
FIG. 12B is a diagram illustrating the shape of the cross section of a suctioning tube according to a modification example.
Figure 12C:
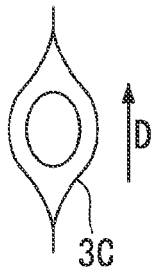
FIG. 12C is a diagram illustrating the shape of the cross section of a suctioning tube according to a modification example.
Figure 12D:
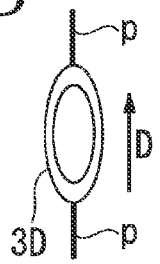
FIG. 12D is a diagram illustrating the shape of the cross section of a suctioning tube according to a modification example.

In addition, in the wiping device 1 in this embodiment, the shape of the cross section of the suctioning tube 3 is oval. However, as modification examples, a rectangular suctioning tube 3A that employs the effect of the suctioning tube 3 in the edge plate B as illustrated in FIG. 12A or similar suctioning tubes 3B, 3C, and 3D that exert the rectification effect caused by rectifying plates p as illustrated in FIG. 12B, 12C, or 12D may also be employed. In addition, in any case, the shape of cross section thereof has the largest dimension thereof along the pulling direction D of the steel sheet P and has a convex shape toward the outside. Accordingly, the wiping gas G that collides with the suctioning tube 3 and is separated vertically is guided vertically along the convex shape of the outside of the suctioning tube 3 to be rectified. Therefore, the generation of turbulence caused by the collision between the flows of the wiping gas G on the outside of the steel sheet P is prevented, and thus the rectification effect as described above is obtained.

Figure 13:
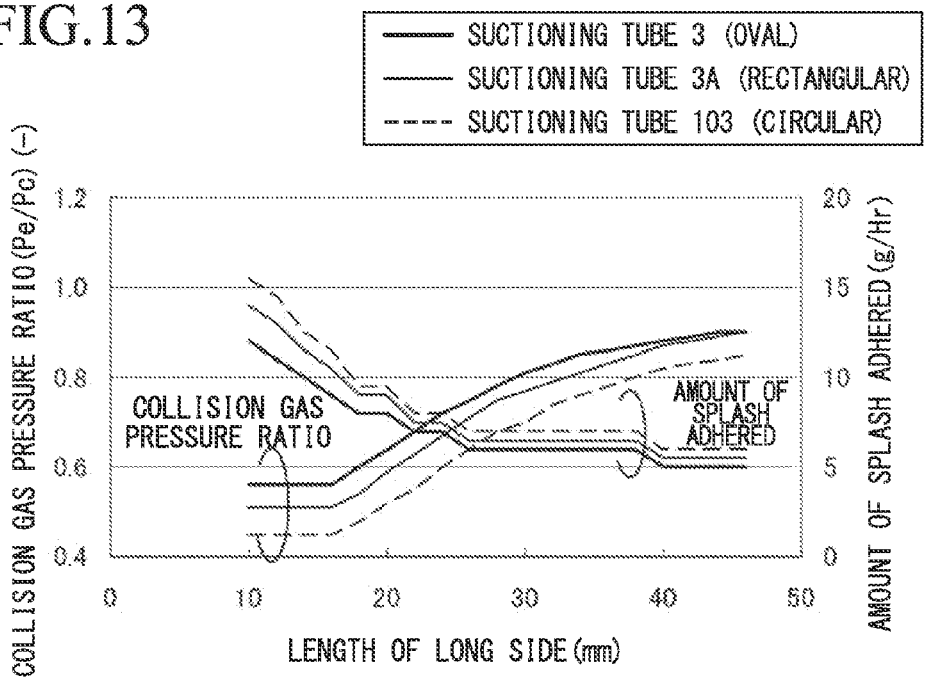
FIG. 13 is a diagram showing the relationship between the length of a long side of the suctioning tube, the collision gas pressure ratio (Pe/Pc), and the amount of splash adhered.

Next, the rectification effect by the shape of the suctioning tube 3 will be described (FIG. 13). In addition, for comparison, in FIG. 13, the case of the suctioning tube 103 having the circular cross section is also illustrated. In the case of the suctioning tube 103 having the circular cross section, after the wiping gas G collides the suctioning tube 103 having the circular cross section, the wiping gas G comes around the suctioning tube 3 having the circular cross section and collides the suctioning tube 103 again, and thus the gas flow is disturbed and the collision point vibrates. On the other hand, in the case of the suctioning tube 3 (oval) or the suctioning tube 3A (rectangular), the wiping gas G that collides with the suctioning tube 3 having such a shape is guided in the vertical direction along the suctioning tube 3. The direction of the gas flow from the wall surface of the suctioning tube 3 to a separation point becomes close to the vertical direction in the suctioning tube 3 (oval) or the suctioning tube 3A (rectangular), the collision pressure at the time of re-collision between the flows of the gas is reduced, and thus the generation of turbulence is prevented. Therefore, it was determined that the rectification effect is degraded compared to the oval and rectangular shapes and the like, and the amount of splash adhered is higher compared to other shapes. In the case of the circular cross section, in order to solve edge overcoating, the length of the long side of the suctioning tube (diameter) needs to be about 35 mm. On the other hand, as for the manufacturing condition of the hot dip coated steel sheet, the minimum value of the distance between the wiping nozzles 2*a* and 2*b* illustrated in FIG. 1 needs to be set to about 10 to 20 mm, and thus it is difficult to install a suctioning tube having the circular cross section. Here, in the wiping device 1 in this embodiment, by employing the suctioning tube 3 in which the shape of the cross section has the largest dimension thereof along the pulling direction D of the steel sheet P and has a convex shape toward the outside, the suctioning tube 3 can be installed between the wiping nozzles 2*a* and 2*b*, and the rectification effect can be exerted even under various operational conditions.

Next, the shape of the cross section of the suctioning tube was examined in detail. In the wiping device 1 in this embodiment, in order to exert the rectification effect, it was made clear by experiment that it is preferable that the length of the long side be 15 to 50 mm and the ratio of the long side to the short side in the cross section be 1.2 to 10. Hereinafter, the contents thereof will be described.

Before using the suctioning tube 3 of the wiping device 1 in this embodiment, a pressure drop at the edge portion E was high and the collision gas pressure ratio (Pe/Pc) was about 0.46. Here, an improved suctioning tube shape was examined when a target pressure ratio of the wiping device 1 that uses the suctioning tube 3 is set to 0.8 or higher.

Regarding the shape of the cross section of the suctioning tube, as described with reference to FIG. 13, it is preferable that an oval shape that has the highest rectification effect on the flows after the collision between the flows of the wiping gas G be used. In addition, since the minimum value of the distance between the wiping nozzles 2*a* and 2*b* illustrated in FIG. 1 needs to be set to about 10 to 20 mm, the outside diameter (short side) of the supply tube 3*b* of the driving gas g for the suctioning tube 3 illustrated in FIG. 2 needs to be 20 mm or less from 10. In the suctioning tube 3, in order to exert the ejector effect of the driving gas g from the supply tube 3*b*, it could be seen that the function as the ejector is maximized by reducing the diameter of the supply tube 3*b* and enhancing the flow rate in the suctioning tube 3. Therefore, in the case where a circular shape is used as the shape of the cross section of the gas supply tube, 6A (an outside diameter of 10.5 mm) which is the minimum diameter for industrial pipes was used.

In Tables 1 to 3, the results of manufacturing suctioning tubes 3 having various oval shapes and examining the effect of solving edge overcoating in a case where compressed air is introduced from the supply tube 3*b* as the driving gas g are shown. In addition, in the following tables, the effect of improving edge overcoating was graded by 4 stages:

4: Pe/Pc>0.9,

3: 0.8≤Pe/Pc≤0.9,

2: 0.6≤Pe/Pc≤0.8,

1: 0.6>Pe/Pc.

As the number in the four stages is higher, the effect of improving edge overcoating is higher. In addition, the metal adhesion situation is graded by 3 stages:

3: no metal adhesion,

2: a long-term operation is possible although metal is adhered,

1: a long-term operation is impossible due to metal adhesion.

[Table 1]

[Table 2]

[Table 3]

From Table 1, in a case where the length of the short side was 10 mm at the minimum, when the length of the long side was 10 mm, it was determined that the effect of improving edge overcoating was insufficient, and furthermore, a long-term use was difficult due to adhesion of metal to the suctioning tube 3. Here, in a case where the length of the long side was 15 mm or greater, it was determined that the volume of air suctioned by the suctioning tube 3 was increased and thus the collision gas pressure ratio (Pe/Pc) was significantly improved. In addition, in a case where the length of the long side was 55 mm or greater, the cross-sectional area of the suctioning tube 3 with respect to the diameter of the supply tube 3*b* became too large, the speed of suctioned air was reduced, and it was determined that the effect of improving edge overcoating was obtained. Accordingly, it could be confirmed that the optimal range of the length of the long side is 15 to 50 mm.

Next, from Table 2, it was determined that in a case where the length of the short side was set to 15 mm, although the volume of air suctioned by the same length of the long side was increased compared to the case where the short side was 10 mm, the air speed in the suctioning tube 3 was reduced, and thus the improvement effect was reduced. Similarly, although the improvement effect was confirmed when the length of the long side was increased, it was determined that in the case where the long side was 55 mm, the effect of improving edge overcoating was not obtained as in the case where the length of the short side is 10 mm. In addition, from Table 3, in the case where the length of the short side was 20 mm, an operable range was further reduced than the case where the length of the short side was 15 mm. Accordingly, it was confirmed that the lower limit of the ratio of the long side to the short side is 1.0 to 1.25, and the optimal range thereof is 1.2 or higher.

Next, the case where the suctioning tube 3A in which the shape of the cross section of the suctioning tube 3 was rectangular was used was examined. Tables 4 to 6 show the examination results. Although the oval tube was manufactured by deforming a circular tube, the rectangular tube can be manufactured by welding steel sheets and thus can be manufactured by using a material with an arbitrary sheet thickness. In the case of the rectangular tube having a short side length of 5 mm, the outside diameter of the supply tube 3*b* needs to be 5 mm or less, and thus the upper limit of the volume of suctioned air was 30 $Nm^3/Hr$. In addition, it was determined that the length of the long side that exerts the effect was 50 mm or less as in the case of the oval shape. In a case of rectangular tubes having short side lengths of 10 and 15 mm, although the volume of suctioned air is improved due to the increase in the cross-sectional area as in the case of the oval shape, the speed of suctioned air is reduced compared to the case of the 5 mm short side, the effect of improving edge overcoating was reduced. In the case of the rectangular tube, it could be confirmed that the ratio of the long side to the short side at which the effect of improving edge overcoating can be exerted is 10 or less.

[Table 4]

[Table 5]

[Table 6]

Next, the same inspection was performed on the suctioning tube 3B in which the shape of the suctioning tube was a rhombus. Tables 7 to 9 show the examination results. In the case of the rhombus, although the volume of suctioned air is reduced compared to the case of the rectangular shape, since the cross-sectional thereof is reduced, the speed of suctioned air is increased. As a result, it was determined that the effect of improving edge overcoating is increased.

[Table 7]

[Table 8]

[Table 9]

In addition, as long as the suctioning tube 3 has the shape by which a target edge overcoating improvement effect is obtained, the amount of splash adhered was about several g/Hr and thus was small, and troubles caused by an increase in the adhesion amount was not confirmed.

From the above knowledge, for the optimal shape, the length of the long side of the suctioning tube was 15 to 50 mm, and the ratio of the long side to the short side in the cross section was 1.2 to 10. In addition, the optimal shape of the suctioning tube varies depending on the target collision gas pressure ratio (Pe/Pc) needed for improving overcoating. Therefore, it should be noted that in cases where the same degree of effect as described above is obtained, the same effect as the present invention is obtained in all the cases.

INDUSTRIAL APPLICABILITY

According to the present invention, by providing the suctioning tube in which the shape of the cross section has the largest dimension thereof along the pulling direction of the steel sheet, the generation of turbulence caused by a direct collision between the flows of the wiping gas on the outside of the steel sheet can be prevented, and a reduction in the collision force of the jet of the wiping gas exerted on the steel sheet at the edge portion of the steel sheet can be suppressed. Therefore, it is possible to prevent edge overcoating and splash.

REFERENCE SYMBOL LIST

1: wiping device
2*a*, 2*b*: wiping nozzle
3, 3A, 3B, 3C, 3D, 103: suctioning tube
3*a*: suctioning port
3*b*: supply tube
4*a*, 4*b*: slit
11: hot dip coating apparatus
12: hot dip coating bath
13: snout
14: sink roll
15: wiping nozzle
A: pressure gauge
B: edge plate
C: center portion
D: pulling direction
d1: distance between wiping nozzle and steel sheet
d2: distance between edge portion and suctioning tube
E: edge portion
F: point disposed inward from edge portion of steel sheet by 3 mm in center portion of steel sheet
G: wiping gas
g: driving gas
P: steel sheet
p: rectifying plate
S: splash
Ug: speed of wiping gas
$\delta_0$: liquid film lifted by stripping

TABLE 1

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example A1 | 10 | 10 | 1.00 | 2.3 | 23 | 30 | 364 | 0.72 | 2 | 1 |
| Example A1 | 15 | 10 | 1.50 | 2.3 | 44 | 35 | 220 | 0.80 | 3 | 2 |
| Example A2 | 20 | 10 | 2.00 | 2.8 | 50 | 40 | 223 | 0.82 | 3 | 2 |

TABLE 1-continued

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Example A3 | 25 | 10 | 2.50 | 2.3 | 87 | 45 | 144 | 0.86 | 3 | 3 |
| Example A4 | 30 | 10 | 3.00 | 2.8 | 84 | 56 | 184 | 0.90 | 3 | 3 |
| Example A5 | 35 | 10 | 3.50 | 2.8 | 102 | 56 | 153 | 0.93 | 4 | 3 |
| Example A6 | 40 | 10 | 4.00 | 2.8 | 119 | 56 | 131 | 0.95 | 4 | 3 |
| Example A7 | 45 | 10 | 4.50 | 2.8 | 136 | 56 | 114 | 0.94 | 4 | 3 |
| Example A8 | 50 | 10 | 5.00 | 2.8 | 153 | 56 | 101 | 0.92 | 4 | 3 |
| Example A9 | 55 | 10 | 5.50 | 3 | 154 | 56 | 101 | 0.79 | 2 | 3 |
| Example A10 | 60 | 10 | 6.00 | 3 | 170 | 56 | 92 | 0.76 | 2 | 3 |

TABLE 2

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example B1 | 15 | 15 | 1.00 | 2.3 | 85 | 39 | 128 | 0.78 | 2 | 1 |
| Example B1 | 20 | 15 | 1.33 | 2.8 | 106 | 46 | 121 | 0.82 | 3 | 3 |
| Example B2 | 25 | 15 | 1.67 | 2.3 | 167 | 53 | 88 | 0.85 | 3 | 3 |
| Example B3 | 30 | 15 | 2.00 | 2.8 | 180 | 58 | 89 | 0.89 | 3 | 3 |
| Example B4 | 35 | 15 | 2.33 | 2.8 | 217 | 62 | 79 | 0.90 | 3 | 3 |
| Example B5 | 40 | 15 | 2.67 | 2.8 | 254 | 66 | 72 | 0.91 | 4 | 3 |
| Example B6 | 45 | 15 | 3.00 | 2.8 | 291 | 66 | 63 | 0.88 | 3 | 3 |
| Example B7 | 50 | 15 | 3.33 | 2.8 | 328 | 66 | 56 | 0.84 | 3 | 3 |
| Example B8 | 55 | 15 | 3.67 | 3 | 346 | 66 | 53 | 0.78 | 2 | 3 |
| Example B9 | 60 | 15 | 4.00 | 3 | 382 | 66 | 48 | 0.67 | 2 | 3 |

TABLE 3

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example C1 | 20 | 20 | 1.00 | 2.8 | 163 | 49 | 84 | 0.78 | 2 | 1 |
| Example C1 | 25 | 20 | 1.25 | 2.3 | 247 | 55 | 62 | 0.80 | 3 | 3 |
| Example C2 | 30 | 20 | 1.50 | 2.8 | 276 | 60 | 61 | 0.84 | 3 | 3 |
| Example C3 | 35 | 20 | 1.75 | 2.8 | 333 | 65 | 54 | 0.85 | 3 | 3 |
| Example C4 | 40 | 20 | 2.00 | 2 | 452 | 68 | 42 | 0.85 | 3 | 3 |
| Example C5 | 45 | 20 | 2.25 | 2.8 | 446 | 68 | 43 | 0.84 | 3 | 3 |
| Example C6 | 50 | 20 | 2.50 | 2.8 | 502 | 68 | 38 | 0.81 | 3 | 3 |
| Example C7 | 55 | 20 | 2.75 | 3 | 539 | 68 | 35 | 0.74 | 2 | 3 |

TABLE 3-continued

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Example C8 | 60 | 20 | 3.00 | 3 | 594 | 68 | 32 | 0.64 | 2 | 3 |

TABLE 4

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Example D1 | 10 | 5 | 2.00 | 1 | 24 | 27 | 313 | 0.72 | 2 | 2 |
| Example D2 | 15 | 5 | 3.00 | 1 | 39 | 32 | 224 | 0.75 | 2 | 2 |
| Example D3 | 20 | 5 | 4.00 | 1 | 54 | 36 | 185 | 0.79 | 2 | 2 |
| Example D4 | 25 | 5 | 5.00 | 1 | 69 | 41 | 163 | 0.84 | 3 | 2 |
| Example D5 | 30 | 5 | 6.00 | 1 | 84 | 50 | 167 | 0.88 | 3 | 2 |
| Example D6 | 35 | 5 | 7.00 | 1 | 99 | 50 | 141 | 0.91 | 4 | 3 |
| Example D7 | 40 | 5 | 8.00 | 1 | 114 | 50 | 123 | 0.92 | 4 | 3 |
| Example D8 | 45 | 5 | 9.00 | 1 | 129 | 50 | 109 | 0.92 | 4 | 3 |
| Example D9 | 50 | 5 | 10.00 | 1 | 144 | 50 | 97 | 0.89 | 3 | 3 |
| Comparative Example D1 | 55 | 5 | 11.00 | 1 | 159 | 50 | 88 | 0.79 | 2 | 1 |
| Comparative Example D2 | 60 | 5 | 12.00 | 1 | 174 | 50 | 80 | 0.71 | 2 | 1 |

TABLE 5

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example E1 | 10 | 10 | 1.00 | 2 | 36 | 29 | 221 | 0.71 | 2 | 2 |
| Example E1 | 15 | 10 | 1.50 | 2 | 66 | 35 | 148 | 0.75 | 2 | 3 |
| Example E2 | 20 | 10 | 2.00 | 2 | 96 | 42 | 121 | 0.79 | 2 | 3 |
| Example E3 | 25 | 10 | 2.50 | 2 | 126 | 47 | 104 | 0.83 | 3 | 3 |
| Example E4 | 30 | 10 | 3.00 | 2 | 156 | 52 | 92 | 0.86 | 3 | 3 |
| Example E5 | 35 | 10 | 3.50 | 2 | 186 | 56 | 83 | 0.88 | 3 | 3 |
| Example E6 | 40 | 10 | 4.00 | 2 | 216 | 59 | 76 | 0.88 | 3 | 3 |
| Example E7 | 45 | 10 | 4.50 | 2 | 246 | 59 | 67 | 0.86 | 3 | 3 |
| Example E8 | 50 | 10 | 5.00 | 2 | 276 | 59 | 60 | 0.82 | 3 | 3 |
| Example E9 | 55 | 10 | 5.50 | 2 | 306 | 59 | 54 | 0.75 | 2 | 3 |
| Example E10 | 60 | 10 | 6.00 | 2 | 336 | 59 | 49 | 0.64 | 2 | 3 |

TABLE 6

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example F1 | 15 | 15 | 1.00 | 2 | 121 | 39 | 90 | 0.73 | 2 | 2 |
| Example F1 | 20 | 15 | 1.33 | 2 | 176 | 44 | 70 | 0.73 | 2 | 3 |
| Example F2 | 25 | 15 | 1.67 | 2 | 231 | 50 | 60 | 0.76 | 2 | 3 |
| Example F3 | 30 | 15 | 2.00 | 2 | 286 | 54 | 53 | 0.78 | 2 | 3 |
| Example F4 | 35 | 15 | 2.33 | 2 | 341 | 58 | 47 | 0.80 | 3 | 3 |
| Example F5 | 40 | 15 | 2.67 | 2 | 396 | 62 | 43 | 0.81 | 3 | 3 |
| Example F6 | 45 | 15 | 3.00 | 2 | 451 | 62 | 38 | 0.79 | 2 | 3 |
| Example F7 | 50 | 15 | 3.33 | 2 | 506 | 62 | 34 | 0.76 | 2 | 3 |
| Example F8 | 55 | 15 | 3.67 | 2 | 561 | 62 | 31 | 0.71 | 2 | 3 |
| Example F9 | 60 | 15 | 4.00 | 2 | 616 | 62 | 28 | 0.61 | 2 | 3 |

TABLE 7

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Example G1 | 10 | 5 | 2.00 | 1 | 12 | 18 | 417 | 0.73 | 2 | 2 |
| Example G2 | 15 | 5 | 3.00 | 1 | 20 | 21 | 299 | 0.76 | 2 | 2 |
| Example G3 | 20 | 5 | 4.00 | 1 | 27 | 24 | 247 | 0.80 | 3 | 2 |
| Example G4 | 25 | 5 | 5.00 | 1 | 35 | 27 | 217 | 0.85 | 3 | 2 |
| Example G5 | 30 | 5 | 6.00 | 1 | 42 | 34 | 222 | 0.89 | 3 | 2 |
| Example G6 | 35 | 5 | 7.00 | 1 | 50 | 34 | 189 | 0.92 | 4 | 3 |
| Example G7 | 40 | 5 | 8.00 | 1 | 57 | 34 | 164 | 0.93 | 4 | 3 |
| Example G8 | 45 | 5 | 9.00 | 1 | 65 | 34 | 145 | 0.93 | 4 | 3 |
| Example G9 | 50 | 5 | 10.00 | 1 | 72 | 34 | 130 | 0.90 | 3 | 3 |
| Comparative Example G1 | 55 | 5 | 11.00 | 1 | 80 | 34 | 117 | 0.79 | 2 | 1 |
| Comparative Example G2 | 60 | 5 | 12.00 | 1 | 87 | 34 | 107 | 0.70 | 2 | 1 |

TABLE 8

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example H1 | 10 | 10 | 1.00 | 2 | 18 | 19 | 295 | 0.73 | 2 | 1 |
| Example H1 | 15 | 10 | 1.50 | 2 | 33 | 23 | 198 | 0.76 | 2 | 2 |
| Example H2 | 20 | 10 | 2.00 | 2 | 48 | 28 | 161 | 0.80 | 3 | 3 |
| Example H3 | 25 | 10 | 2.50 | 2 | 63 | 32 | 139 | 0.85 | 3 | 3 |
| Example H4 | 30 | 10 | 3.00 | 2 | 78 | 35 | 123 | 0.89 | 3 | 3 |
| Example H5 | 35 | 10 | 3.50 | 2 | 93 | 37 | 111 | 0.92 | 4 | 3 |
| Example H6 | 40 | 10 | 4.00 | 2 | 108 | 40 | 102 | 0.93 | 4 | 3 |
| Example H7 | 45 | 10 | 4.50 | 2 | 123 | 40 | 89 | 0.92 | 4 | 3 |

TABLE 8-continued

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Example H8 | 50 | 10 | 5.00 | 2 | 138 | 40 | 80 | 0.87 | 3 | 3 |
| Example H9 | 55 | 10 | 5.50 | 2 | 153 | 40 | 72 | 0.78 | 2 | 2 |
| Example H10 | 60 | 10 | 6.00 | 2 | 168 | 40 | 65 | 0.69 | 2 | 2 |

TABLE 9

| | Long side (mm) | Short side (mm) | Long side/ Short side | Thickness (mm) | Cross Sectional area ($mm^2$) | Maximum amount of suctioned air ($Nm^3/Hr$) | Speed of suctioned air (m/s) | Collision gas pressure ratio Pe/Pc (—) | Edge overcoating Improvement effect | Metal Adhesion situation |
|---|---|---|---|---|---|---|---|---|---|---|
| Comparative Example I1 | 15 | 15 | 1.00 | 2 | 61 | 35 | 160 | 0.76 | 1 | 2 |
| Example I1 | 20 | 15 | 1.33 | 2 | 88 | 40 | 125 | 0.80 | 3 | 3 |
| Example I2 | 25 | 15 | 1.67 | 2 | 116 | 44 | 106 | 0.85 | 3 | 3 |
| Example I3 | 30 | 15 | 2.00 | 2 | 143 | 48 | 94 | 0.89 | 3 | 3 |
| Example I4 | 35 | 15 | 2.33 | 2 | 171 | 52 | 84 | 0.90 | 3 | 3 |
| Example I5 | 40 | 15 | 2.67 | 2 | 198 | 55 | 77 | 0.90 | 3 | 3 |
| Example I6 | 45 | 15 | 3.00 | 2 | 226 | 55 | 67 | 0.88 | 3 | 3 |
| Example I7 | 50 | 15 | 3.33 | 2 | 253 | 55 | 60 | 0.84 | 3 | 3 |
| Example I8 | 55 | 15 | 3.67 | 2 | 281 | 55 | 54 | 0.76 | 2 | 3 |
| Example I9 | 60 | 15 | 4.00 | 2 | 308 | 55 | 49 | 0.66 | 2 | 3 |

The invention claimed is:

1. A wiping device which blows a wiping gas toward a steel sheet from a pair of wiping nozzles disposed on both sides of the steel sheet so as to face sheet surfaces of the steel sheet, wherein the steel sheet is interposed between the pair of wiping nozzles and is pulled from a hot dip coating bath, the device comprising:

suctioning tubes, wherein:

the suctioning tubes are disposed on both sides in a width direction of a section of the steel sheet, the section being positioned between the pair of wiping nozzles, so that a longitudinal direction of the suctioning tubes is in parallel to the width direction of the steel sheet;

the suctioning tubes have a suctioning port that suctions an air;

the suctioning port is disposed to face a side end surface of the steel sheet;

a cross-sectional shape of the suctioning tubes has the largest dimension thereof along a pulling direction of the steel sheet and the cross-sectional shape of the suctioning tubes is selected from a group consisting of oval, rectangle and rhombus; and wherein:

the wiping nozzles are nozzles which have linear slits that extend over the width direction of the steel sheet;

the suctioning tubes are located between the wiping nozzles when seen in the width direction of the steel sheet;

in the suctioning tubes, a ratio of a long side of the cross section with respect to a short side of the cross section is 1.2 to 10;

a distance between the suctioning port and the side end surface of the steel sheet is 2 to 15 mm;

when seen in a direction perpendicular to the steel sheet, the suctioning tubes and the linear slit of the wiping nozzle overlap with each other;

the suctioning tubes optionally include a rectifying plate; and the wiping gas that collides with the suctioning tubes is guided in a vertical direction along the suctioning tubes so that a generation of turbulence is prevented.

2. The wiping device according to claim 1, wherein a width of the suctioning tubes in the pulling direction of the steel sheet is 15 to 50 mm.

3. A hot dip coating apparatus comprising:

a wiping device which blows a wiping gas toward a steel sheet from a pair of wiping nozzles disposed on both sides of the steel sheet so as to face sheet surfaces of the steel sheet, wherein the steel sheet is interposed between the pair of wiping nozzles and is pulled from a hot dip coating bath, wherein the wiping device comprising:

suctioning tubes, wherein:

the suctioning tubes are disposed on both sides in a width direction of a section of the steel sheet, the section being positioned between the pair of wiping nozzles, so that a longitudinal direction of the suctioning tubes is in parallel to the width direction of the steel sheet, the suctioning tubes have a suctioning port that suctions an air, the suctioning port is disposed to face a side end surface of the steel sheet, a cross-sectional shape of the suctioning tubes has the largest dimension thereof along a pulling direction of the steel sheet and the cross-sectional shape of the suctioning tubes is selected from a group consisting of oval, rectangle and rhombus;

wherein the wiping nozzles are nozzles which have linear slits that extend over the width direction of the steel sheet;

the suctioning tubes are located between the wiping nozzles when seen in the width direction of the steel sheet;

in the suctioning tubes, a ratio of a long side of the cross section with respect to a short side of the cross section is 1.2 to 10;

a distance between the suctioning port and the side end surface of the steel sheet is 2 to 15 mm;

when seen in a direction perpendicular to the steel sheet, the suctioning tubes and the linear slit of the wiping nozzle overlap with each other;

the suctioning tubes optionally include a rectifying plate; and the wiping gas that collides with the suctioning tubes is guided in a vertical direction along the suctioning tubes so that a generation of turbulence is prevented.

4. The hot dip coating apparatus according to claim 3, wherein a width of the suctioning tubes in the pulling direction of the steel sheet is 15 to 50 mm.

* * * * *